US006364240B1

(12) United States Patent
Madrzak et al.

(10) Patent No.: US 6,364,240 B1
(45) Date of Patent: Apr. 2, 2002

(54) PROCESS AND WINDING MACHINE FOR WINDING A MATERIAL WEB

(75) Inventors: Zygmunt Madrzak; Matthias Wohlfahrt, both of Heidenheim (DE)

(73) Assignee: Voith Sulzer Papiertechnik Patent GmbH, Heidenheim (DE)

( * ) Notice: Subject to any disclaimer, the term of this patent is extended or adjusted under 35 U.S.C. 154(b) by 0 days.

(21) Appl. No.: 09/512,299

(22) Filed: Feb. 24, 2000

(30) Foreign Application Priority Data

Mar. 10, 1999 (DE) ..... 199 10 569

(51) Int. Cl.[7] ..... B65H 19/26; B65H 18/16

(52) U.S. Cl. ..... 242/526.3; 242/527.2; 242/542.3

(58) Field of Search ..... 242/526.3, 527.2, 242/527.3, 527.4, 527.5, 527.6, 527.7, 542.3

(56) References Cited

U.S. PATENT DOCUMENTS

| | | | | |
|---|---|---|---|---|
| 1,894,253 A | * | 1/1933 | McCarthy et al. | 242/526.3 |
| 4,695,004 A | * | 9/1987 | Grossmann et al. | 242/526.3 |
| 5,360,179 A | | 11/1994 | Vesterinen et al. | 242/526.3 |
| 5,782,426 A | * | 7/1998 | Kinnunen et al. | 242/526.3 |
| 5,842,664 A | * | 12/1998 | Akerlund | 242/526.3 |
| 6,029,927 A | | 2/2000 | Wohlfahrt et al. | |

FOREIGN PATENT DOCUMENTS

| | | |
|---|---|---|
| DE | 1935583 | 1/1971 |
| DE | 2721883 | 11/1978 |
| DE | 8512699.3 | 7/1986 |
| DE | 3515519 | 10/1986 |
| DE | 9103749.2 | 8/1991 |
| DE | 4208746 | 5/1993 |
| DE | 9407262.0 | 8/1994 |
| DE | 19710282 | 9/1998 |
| DE | 29813365 | 12/1998 |
| EP | 543788 | 5/1993 |
| WO | 97/48632 | 12/1997 |

OTHER PUBLICATIONS

Federle et al., "Papierschneiden mit Laser", *Papier+Kunstoff–Verarbeiter*, pp. 23–39 (Jul. 1992).

* cited by examiner

*Primary Examiner*—John M. Jillions
(74) *Attorney, Agent, or Firm*—Greenblum & Bernstein, P.L.C.

(57) ABSTRACT

Process and apparatus for winding a material web. The process includes guiding the material web over a carrying roll and through a nip formed between the carrying roll and a new reel spool, at least partially cutting the material web with at least one contactless cutter during a reel spool change to form a new web leader, and additionally cutting the material web with at least one separation element. The apparatus includes a reel spool, and a carrying roll. The reel spool and the carrying roll may be positioned to form a winding nip. The material web may be guided over the carrying roll and through the winding nip, at least one contactless cutter can be adapted to cut a web leader during a reel spool change, and at least one separation element can be positioned for additionally cutting the material web.

48 Claims, 4 Drawing Sheets

PROCESS AND WINDING MACHINE FOR WINDING A MATERIAL WEB

CROSS-REFERENCE TO RELATED APPLICATIONS

The present application claims priority under 35 U.S.C. § 119 of German Patent Application No. 199 10 569.3, filed on Mar. 10, 1999, the disclosure of which is expressly incorporated by reference herein in its entirety.

BACKGROUND OF THE INVENTION

1. Field of the Invention

The present invention relates to a process for winding a material web, e.g., a paper or cardboard web, onto a reel spool. The material web is guided over a carrying roll, and a winding nip is formed between the carrying roll and the reel spool. The material web is at least partially cut for each reel spool change, in which, via at least one contactless cutter, a new, e.g., pointed, web leader is cut. The invention also relates to the winding machine.

2. Discussion of Background Information

Such a winding machine is used, e.g., at the end of a machine for producing or refining a material web. However, it can also be used, e.g., to re-wind an already completely wound reel. The machine in question may, e.g., be a paper, cardboard, or tissue machine.

A winding machine of the type generally discussed above is known, e.g., from EP 0 543 788 A1. In this known winding machine, a waterjet cutter is provided, e.g., as a contactless cutter.

With a contactless cutter, the material web can be cut without disturbing the travel of the web. It is also possible to cut the material web directly on the carrying roll, thus, achieving a more stable web guidance. However, with such a contactless cutter, problems can arise relating to operational safety and reliability of the cutting process at the time of a reel spool change during winding of the web. Further, the reliability of contactless cutters can be inadequate in many cases. By way of example, with a waterjet cutter, the waterjet nozzles may become clogged or coated, which results in a reduction of the jet pulse and, thereby, in a degradation of cutting performance. The consequence is a defective separation process, which causes correspondingly more waste paper and reduces the productivity of the entire paper machine and/or coating machine.

SUMMARY OF THE INVENTION

The present invention provides a process as well as a winding machine of the type generally discussed above which ensures improved efficiency of the separation process and, therefore overall higher productivity of the machine in question.

With regard to the process, the instant invention includes at least one additional separation element that is utilized to cut the material web.

Because of this design, significantly higher efficiency of the separation process is achieved, which allows correspondingly higher productivity of the paper machine or coating machine in question. The advantages achieved are brought to bear in particular at higher speeds. A chopping knife or the like may be used, for example, as a separation element.

For example, it is possible for only partial separation to occur with the contactless cutter. Thus, it is possible, for example, that the first separation element, i.e., the contactless cutter, can still be active while the second separation element is being been put into operation. In this case, the first separation element has not yet completed full separation of the material web.

In a preferred practical embodiment, at least one separation element acting on the full width of the web is used.

A waterjet cutter, an airjet cutter, a laser cutter, and/or the like may be used as the contactless cutter.

In certain cases, it may be expedient for the material web to be cut by the contactless cutter upstream of, relative to the web travel direction, the carrying roll.

However, the material web may also be cut on the carrying roll by the contactless cutter.

In certain cases, it may also be advantageous for the material web to be cut by the contactless cutter on the new, still empty reel spool.

The separation element can be used, e.g., immediately downstream of; relative to the web travel direction, the winding nip.

In an expedient practical embodiment, the separation element can be used downstream in the web travel direction after the contactless cutter. In this case, the separation element can always be activated after the expiration of a specific period of time, after approximately 0–5 seconds at the latest, and preferably after approximately 1–3 seconds, after activation of the contactless cutter, However, it may also be expedient in certain cases for the cutting process effected by the contactless cutter to be monitored by at least one sensor and for the separation element to be activated, e.g., by a control aid/or regulating device, only in those cases when a defective cutting process has been previously detected.

It is also advantageous for at least one operating parameter of the contactless cutter to be monitored by at least one sensor. Thus, in the case of a waterjet nozzle, the pressure, e.g., call be monitored.

Alternatively or in addition, the winding onto the new reel spool can be monitored by at least one sensor. An optical sensor, e.g., can be provided and a gray value measurement can be performed.

Expediently, the separation element can be used upstream of, relative to the web travel direction, the contactless cutter and preferably above a scrap mixer. Consequently, the material web must be re-transferred and guided onto the reel spool.

Moreover, the winding machine according to the instant invention includes at least one separation element that is additionally provided for cutting the material web.

The separation element can be pivotable between an operational position for cutting the material and an idle position.

The present invention is directed to a process for winding a material web that includes guiding the material web over a carrying roll and through a nip formed between the carrying roll and a new reel spool, at least partially cutting the material web with at least one contactless cutter during a reel spool change to form a new web leader, and additionally cutting the material web with at least one separation element.

According to a feature of the invention, the new web leader can include a pointed portion. Further, the material web can include one of paper and cardboard.

In accordance with another feature of the instant invention, the at least one separation element extends across an entire web width.

According to still another feature of the present invention, the contactless cutter can include one of a waterjet cutter, an airjet cutter, and a laser cutter.

According to a further feature of the invention, the contactless cutter can cut the material web upstream of, relative to a web travel direction, the carrying roll. In accordance with a still further feature of the instant invention, the contactless cutter may cut the material web downstream of, relative to a web travel direction, the carrying roll.

In accordance with still another feature of the present invention, the contactless cutter may cut the material web where it is supported on the carrying roll. According to another feature, the contactless cutter can cut the material web where it is in contact with the new reel spool.

According to another aspect of the invention, the additional cutting by the separation element may occur downstream of, relative to the web travel direction, the winding nip.

Further, the additional cutting by the separation element may occur downstream, relative to the web travel direction, the contactless cutter. The process may also include activating the separation element after expiration of a specific time period after activation of the contactless cutter. The specific time period can be between approximately 0 and 5 seconds, and preferably between approximately 1 and 3 seconds. The process may also include monitoring the cutting by the contactless cutter with at least one sensor, and activating the separation element with a control and/or regulating device when a defective cutting by the contactless cutter is detected, The process can also include monitoring at least one operating parameter of the contactless cutter with at least one sensor.

Moreover, the process can further include monitoring winding of the web onto the new reel spool with at least one sensor.

The separation element can be located upstream from, relative to the web travel direction, the contactless cutter. Further, the separation element may be located above a scrap mixer.

The present invention is directed to an apparatus for winding a material web that includes a reel spool, and a carrying roll. The reel spool and the carrying roll may be positioned to form a winding nip. The material web may be guided over the carrying roll and through the winding nip, at least one contactless cutter can be adapted to cut a web leader during a reel spool change, and at least one separation element can be positioned for additionally cutting the material web.

In accordance with a feature of the present invention, the at least one contactless cutter can be adapted for forming a pointed portion in the web leader. The material web comprises one of a paper and a cardboard web.

According to another feature of the invention, the at least one separation element can be arranged to extend over an entire width of the web.

According to still another feature of the invention, the contactless cutter can include at least one of a waterjet cutter, an airjet cutter, and a laser cutter.

In accordance with a further feature of the invention, the contactless cutter can be arranged upstream of, relative to a web travel direction, the carrying roll. According to another feature of the invention, the contactless cutter can be arranged downstream of, relative to a web travel direction, the carrying roll.

In accordance with a still further feature of the present invention, the contactless cutter can be positioned to cut the material web where it is supported on the carrying roll. According to another feature of the invention, the apparatus can include a new reel spool positioned to take up the new leader of the material web, and the contactless cutter can be positioned to cut the material web where it is in contact with the new, reel spool.

According to another aspect of the invention, the separation element may be positioned downstream of, relative to a web travel direction, the carrying roll. In accordance with still another aspect of the invention, the separation element may be positioned downstream of the contactless cutter, relative to a web travel direction. Further, a control and/or regulating device can be adapted to activate the separation element immediately after activation of the contactless cutter. Still further, at least one sensor can be positioned to detect cutting of the web by the contactless cutter, and a control and/or regulation device may be adapted to activate the separation element when a defective cutting by the contactless cutter is detected by the at least one sensor.

In accordance with still another aspect of the present invention, at least one sensor may be positioned to monitor at least one operational parameter of the contactless cutter.

According to another feature of the instant invention, a new reel spool may be positioned to receive the web after cutting by the contactless cutter, and at least one sensor may be positioned to monitor winding of the web onto the new reel spool.

The separation element can be arranged upstream of, relative to a web travel direction, the contactless cutter and positioned above a scrap mixer.

Further, the separation element can be pivotably located between an operating position adapted to cut the material web and an idle position.

The present invention is directed to a process for winding a material web that includes guiding the material web over a carrying roll and through a nip formed between the carrying roll and a new reel spool, at least partially cutting the material web with at least one contactless cutter positioned downstream of the nip, relative to a web travel direction, during a reel spool change to form a new web leader, and additionally cutting the material web with at least one separation element.

According to a feature of the invention, the additional cutting of the material may occur downstream of the at least partial cutting of the material web.

In accordance with another feature of the instant invention, the at least partial cutting of the material web can include cutting the material web where it is in contact with the new reel spool.

According to still another feature of the invention, the at least partial cutting of the material web can include cutting the material web where it is unsupported.

The invention is directed to an apparatus for winding a material web that includes a reel spool and a carrying roll. The reel spool and the carrying roll are positioned to form a winding nip, and the material web is guided over the carrying roll and through the winding nip. At least one contactless cutter, which is positioned downstream from the winding nip, relative to the web travel direction, is adapted to cut a web leader during a reel spool change, and at least one separation element is positioned for additionally cutting the material web.

In accordance with a feature of the present invention, the at least one separation element can be positioned downstream of the contactless cutter.

According to another feature of the invention, the contactless cutter can be positioned to cut the material web where it is in contact with the new reel spool.

In accordance with yet another feature of the instant invention, the contactless cutter may be positioned to cut the material web where it is unsupported Other exemplary embodiments and advantages of the present invention may be ascertained by reviewing the present disclosure and the accompanying drawing.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF THE PRESENT INVENTION

The particulars shown herein are by way of example and for purposes of illustrative discussion of the embodiments of the present invention only and are presented in the cause of providing what is believed to be the most usefull and readily understood description of the principles and conceptual aspects of the present invention. In this regard, no attempt is made to show structural details of the present invention in more detail than is necessary for the fundamental understanding of the present invention, the description taken with the drawings making apparent to those skilled in the art how the several forms of the present invention may be embodied in practice.

Figure 1:
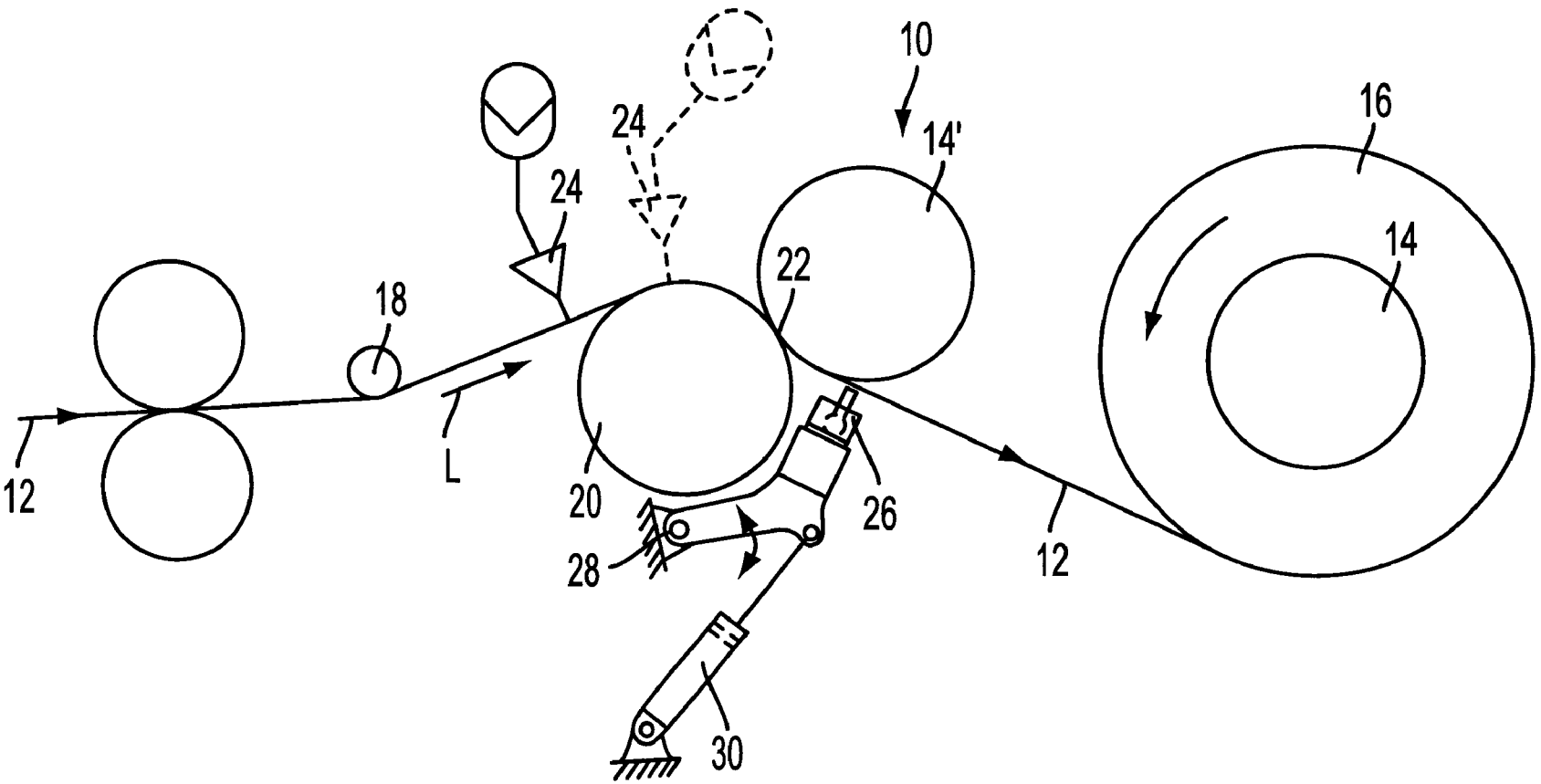
FIG. 1 schematically illustrates an exemplary embodiment of a winding machine according to the present invention.

FIG. 1 schematically illustrates an exemplary embodiment of a winding machine 10 for winding a material web 12 onto a reel spool 14 and 14'. Material web 12 can be, e.g., a paper, cardboard, or tissue web. Thus, winding machine 10 can be provided, e.g., at the end of a paper, cardboard, or tissue machine.

To produce a wound roll 16, material web 12 is guided, downstream from a width adjusting roll 18, over a carrying roll 20, which forms a winding nip 22 with an empty reel spool 14' or with a resulting wound roll 16, which is wound on reel spool 14. Carrying roll 20 and resulting wound roll 16 can be held in contact with each other during the winding process to maintain winding nip 22.

Winding machine 10 is shown in an operational phase immediately before a reel spool change, i.e., in which material web 12 must be cut to begin winding on new reel 14'. Finished wound roll 16 has already been removed from carrying roll 20, and assumes a new position. In the region between carrying roll 20 and finished wound roll 16, the new, still empty reel spool 14' is already being held ready to take up material web 12. Winding nip 22 is being formed between carrying roll 20 and new reel spool 14'.

Upon tie cutting of material web 12, a new, e.g., pointed, web leader, which is then wound onto new, still empty reel spool 14', can be cut by a contactless cutter 24.

Contactless cutter 24 can be, e.g., a waterjet cutter, an airjet cutter, a laser cutter, and/or the like. In the exemplary present case, a waterjet cutter operated with high-pressure is depicted. Moreover, contactless cutter 24 can be arranged upstream of, relative to web travel direction L, carrying roll 20 and at a distance therefrom. Further, contactless cutter 24 can be positioned (as depicted in dashed lines) so that web 12 is cut where it is supported on carrying roll 20.

To cut material web 12, at least one separation element 26 is additionally provided. At least one separation element 26 call be structured to act across the entire width of web 12. In the present case, separation element 26 can be arranged downstream of, relative to web travel direction L, winding nip 22 and at a distance from carrying roll 20 and new reel spool 14'. Thus, in the present exemplary embodiment, separation element 26 can be provided downstream of contactless cutter 24. Separation element 26 can be formed, e.g., with a chopping knife or the like.

As can be seen in FIG. 1, separation element 26 can be pivotably arranged around an axis 28 for positioning separation element 26 in an operational position for cutting material web 12, as depicted in FIG. 1 and in an idle position located thereunder. Thus, separation element 26 can be downwardly pivotable starting from the operational position depicted in FIG. 1. A timely pivoting can occur by at least one cylinder/piston unit 30. Separation element 26 can include, e.g., at least one impact knife or the like, which is driven in the present case to cut material web 12 from below.

Figure 1A:
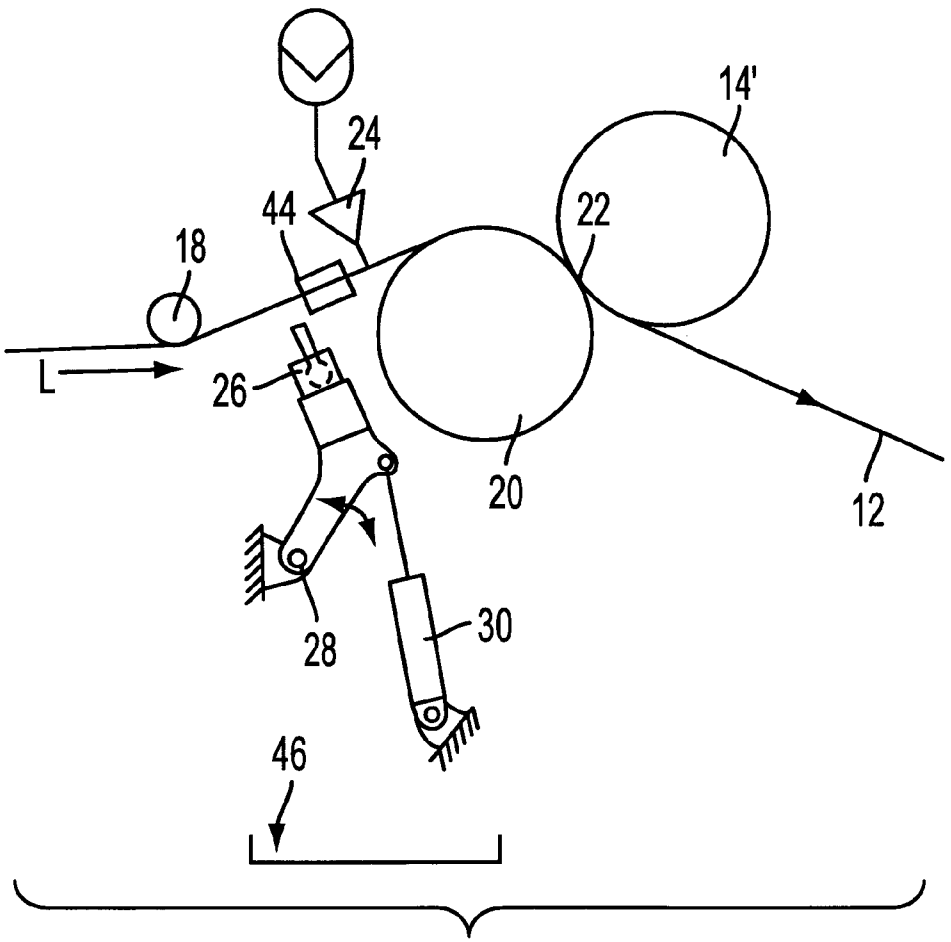
FIG. 1A schematically illustrates an alternative arrangement of the winding machine in accordance with the present invention.

In an alternative arrangement depicted in part in FIG. 1A, separation element 26 is depicted upstream of, i.e., ahead of, contactless cutter 24. Moreover, separation element 26 can be positioned above a scrap mixer 46. In this embodiment, additional guidance device 48 may be required to continue guidance of web 12 after separation device 26. Additional guidance device 48 can include, e.g., suction elements and/or blower elements and/or guide elements.

Figure 2:
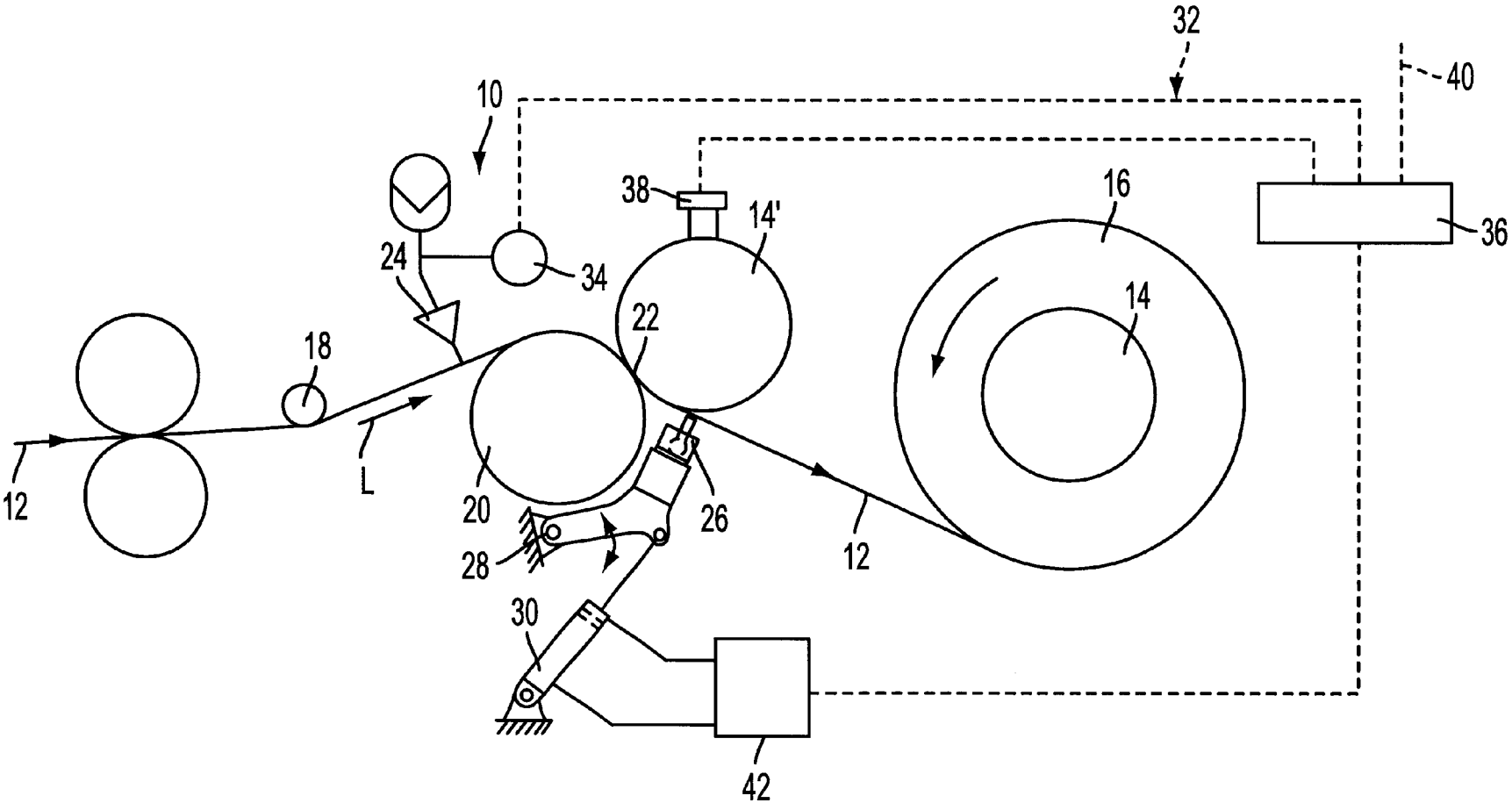
FIG. 2 schematically illustrates the winding machine depicted in FIG. 1 with an associated control and/or regulating device.

FIG. 2 schematically illustrates winding machine 10 as depicted in FIG. 1 that also shows an associated control and/or regulating device 32.

At least one sensor 34 can be provided for monitoring the cutting process effected by contactless cutter 24. Sensor 34 can be coupled to a regulator 36 of control and/or regulating device 32. In the exemplary case, sensor 34 can deliver to regulator 36 the actual value for the pressure of contactless cutting device 24, e.g., formed by a waterjet cutter or waterjet nozzle. In addition, a sensor 38 can be provided for monitoring the winding onto new reel spool 14'. Sensor 38 can also be coupled to regulator 36 to deliver a corresponding actual value for the winding in question. Regulator 36 may also receive at least one set point value 40, with which respective actual values can be compared. By the regulated variable supplied by regulator 40, working pressure 42 for cylinder/piston unit 30 associated with separation element 26 may be appropriately adjusted.

Control and/or regulating device 32 can be designed such that separation element 26 is activated only in those cases when a defective cutting process has been previously detected. Alternatively or in addition, the activation of separation element 26 can occur as a function of the winding onto new reel spool 14' monitored by sensor 38.

Figure 3:
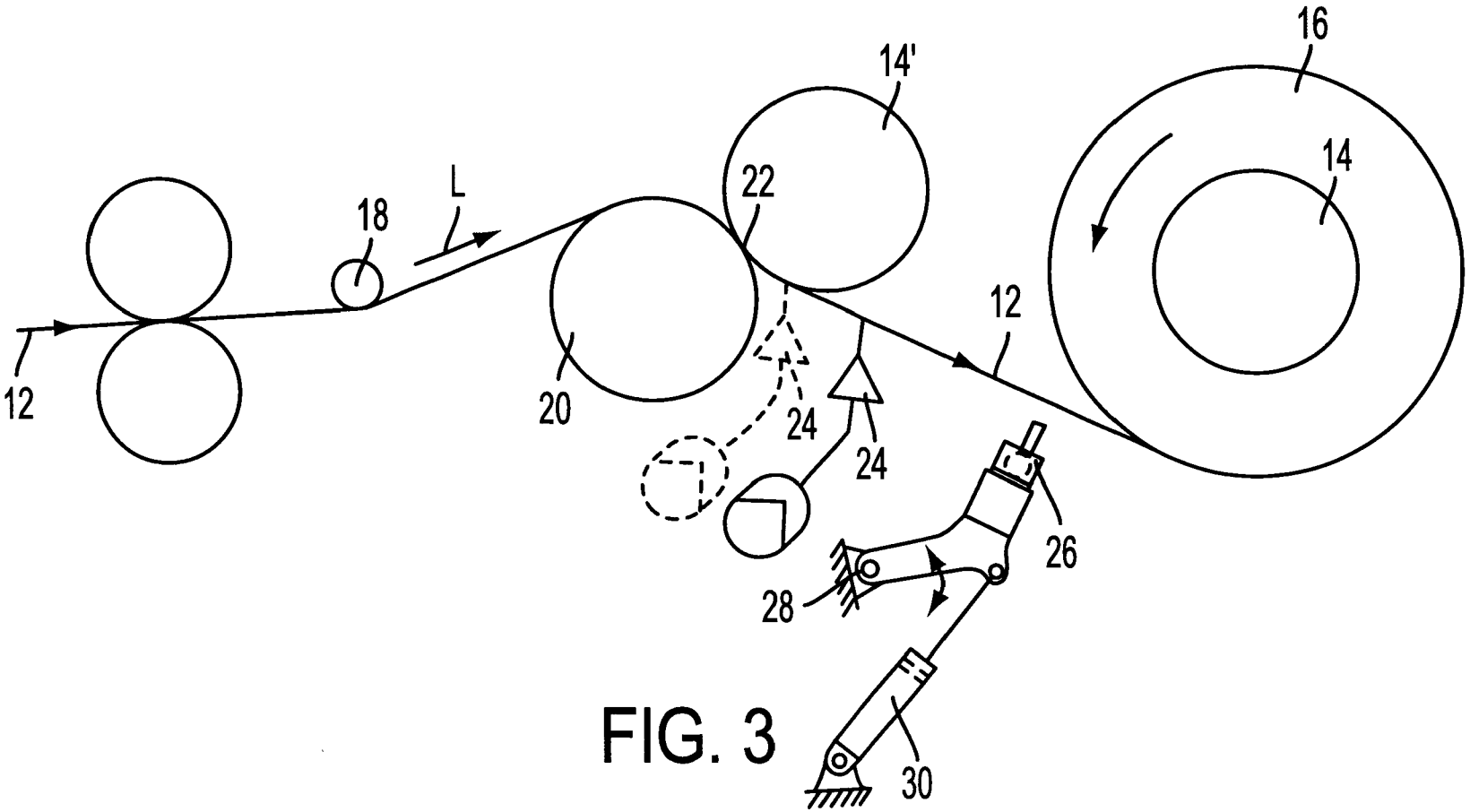
FIG. 3 schematically illustrates another alternative arrangement of the winding machine in accordance with the present invention.

FIG. 3 schematically illustrates another alternative arrangement of the instant invention. In particular, contactless cutter 24 can be positioned downstream of winding nip 22. Moreover, it may be particularly advantageous for contactless cutter 24 to be arranged to cut web 12 while it is supported on (or is in contact with) new reel spool 14–(as shown in dashed lines). Therefore, contactless cutter can be adjustably positionable to cut web 12 where it is supported on (or is in contact with) new reel spool 14' or where it is unsupported, e.g., between new reel spool 14' and wound roll 16.

It is noted that the foregoing examples have been provided merely for the purpose of explanation and are in no way to be construed as limiting of the present invention. While the present invention has been described with reference to an exemplary embodiment, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular means, materials and embodiments, the present invention is not intended to be limited to the particulars disclosed herein; rather, the present invention extends to all functionally equivalent structures, methods and uses, such as are within the scope of the appended claims.

LIST OF REFERENCE CHARACTERS

10 Winding machine
12 Material web
14 Reel spool
14' New reel spool
16 Wound roll
18 Width adjusting roll
20 Carrying roll
22 Winding nip
24 Contactless cutter
26 Separation element
28 Pivot axis
30 Cylinder/piston unit
32 Control and/or regulating device
34 Sensor
36 Regulator
38 Sensor
40 Set point value
42 Working pressure
44 Additional guidance device
46 Scrap mixer
L Web travel direction

What is claimed is:

1. A process for winding a material web comprising:

guiding the material web over a carrying roll and through a nip formed between the carrying roll and a new reel spool;

at least partially cutting the material web with at least one contactless cutter during a reel spool change to form a new web leader; and additionally cutting across an entire width of the material web with at least one separation element.

2. The process in accordance with claim 1, wherein said new web leader comprises a pointed portion.

3. The process in accordance with claim 2, wherein said material web comprises one of paper and cardboard.

4. The process in accordance with claim 1, wherein the at least one separation element extends across the entire web width.

5. The process in accordance with claim 1, wherein the contactless cutter comprises one of a waterjet cutter, an airjet cutter, and a laser cutter.

6. The process in accordance with claim 1, wherein the contactless cutter cuts the material web upstreaam of, relative to a web travel direction, the carrying roll.

7. The process in accordance with claim 1, wherein the contactless cutter cuts the material web downstream of, relative to a web travel direction, the carrying roll.

8. The process in accordance with claim 1, wherein the contactless cutter cuts the material web where it is in contact with the new reel spool.

9. The process in accordance with claim 1, wherein the additional cutting by the separation element occurs downstream of, relative to the web travel direction, the winding nip.

10. The process in accordance with claim 1, wherein the additional cutting by the separation element occurs downstream, relative to the web travel direction, the contactless cutter.

11. The process in accordance with claim 10, further comprising activating the separation element after expiration of a specific time period after activation of the contactless cutter.

12. The process in accordance with claim 11, wherein the specific time period is between approximately 0 and 5 seconds.

13. The process in accordance with claim 11, wherein the specific time period is between approximately 1 and 3 seconds.

14. The process in accordance with claim 10, further comprising monitoring the cutting by the contactless cutter with at least one sensor; and activating the separation element with a control and/or regulating device when a defective cutting by the contactless cutter is detected.

15. The process in accordance with claim 1, further comprising monitoring at least one operating parameter of the contactless cutter with at least one sensor.

16. The process in accordance with claim 1, further comprising monitoring winding of the web onto the new reel spool with at least one sensor.

17. The process in accordance with claim 1, wherein the separation element is located upstream from, relative to the web travel direction, the contactless cutter.

18. The process in accordance with claim 17, wherein said separation element is located above a scrap mixer.

19. The process in accordance with claim 1, wherein the contactless cutter cuts the material web where it is supported on the carrying roll.

20. An apparatus for winding a material web comprising:

a reel spool;

a carrying roll;

said reel spool and said carrying roll positioned to form a winding nip, wherein the material web is guided over said carrying roll and through the winding nip;

at least one contactless cutter adapted to cut a web leader during a reel spool change; and at least one separation element positioned for additionally cutting across an entire width of the material web.

21. The apparatus in accordance with claim 20, wherein said at least one contactless cutter is adapted for forming a pointed portion in said web leader.

22. The apparatus in accordance with claim 21, wherein the material web comprises one of a paper and a cardboard web.

23. The apparatus in accordance with claim 20, wherein said at least one separation element is arranged to extend over the entire width of the web.

24. The apparatus in accordance with claim 20, wherein said contactless cutter comprises at least one of a waterjet cutter, an airjet cutter, and a laser cutter.

25. The apparatus in accordance with claim 20, wherein said contactless cutter is arranged upstream of, relative to a web travel direction, said carrying roll.

26. The apparatus in accordance with claim 20, wherein said contactless cutter is arranged downstream of, relative to a web travel direction, said carrying roll.

27. The apparatus in accordance with claim 20, further comprising a new reel spool positioned to take up the new leader of the material web; and said contactless cutter being positioned to cut the material web where it is in contact with said new, reel spool.

28. The apparatus in accordance with claim 20, wherein said separation element is positioned downstream of relative to a web travel direction, said carrying roll.

29. The apparatus in accordance with claim 20, wherein said separation element is positioned downstream of said contactless cutter, relative to a web travel direction.

30. The apparatus in accordance with claim 29, further comprising a control and/or regulating device adapted to activate said separation element immediately after activation of said contactless cutter.

31. The apparatus in accordance with claim 20, further comprising:

at least one sensor positioned to detect cutting of the web by said contactless cutter; and a control and/or regulation device adapted to activate said separation element when a defective cutting by said contactless cutter is detected by said at least one sensor.

32. The apparatus in accordance with claim 20, further comprising at least one sensor positioned to monitor at least one operational parameter of said contactless cutter.

33. The apparatus in accordance with claim 20, further comprising:

a new reel spool positioned to receive the web after cutting by said contactless cutter; and at least one sensor positioned to monitor winding of the web onto said new reel spool.

34. The apparatus in accordance with claim 20, wherein said the separation element is arranged upstream of, relative to a web travel direction, said contactless cutter and positioned above a scrap mixer.

35. The apparatus in accordance with claim 20, wherein said separation element is pivotably located between an operating position adapted to cut the material web and an idle position.

36. The apparatus in accordance with claim 20, wherein said contactless cutter is positioned to cut the material web where it is supported on said carrying roll.

37. A process for winding a material web comprising:

guiding the material web over a carrying roll and through a nip formed between the carrying roll and a new reel spool;

at least partially cutting the material web with at least one contactless cutter positioned downstream of the nip, relative to a web travel direction, during a reel spool change to form a new web leader; and additionally cutting across an entire width of the material web with at least one separation element.

38. The process in accordance with claim 37, wherein said additional cutting of the material occurs downstream of said at least partial cutting of the material web.

39. The process in accordance with claim 37, wherein said at least partial cutting of the material web comprises cutting the material web where it is in contact with said new reel spool.

40. The process in accordance with claim 37, wherein said at least partial cutting of the material web comprises cutting the material web where it is unsupported.

41. The process in accordance with claim 37, further comprising:

monitoring cutting by the at least one contactless cutter with a sensor; and activating the separation element when a defective cutting by the at least one contactless cutter is detected by the sensor.

42. A process for winding a material web comprising:

guiding the material web over a carrying roll and through a nip formed between the carrying roll and a new reel spool;

at least partially cutting the material web with at least one contactless cutter during a reel spool change to form a new web leader;

additionally cutting the material web with at least one separation element;

monitoring cutting by the at least one contactless cutter with a sensor; and activating the separation element when a defective cutting by the at least one contactless cutter is detected by the sensor.

43. An apparatus for winding a material web comprising:

a reel spool;

a carrying roll;

said reel spool and said carrying roll positioned to form a winding nip, wherein the material web is guided over said carrying roll and through the winding nip;

at least one contactless cutter adapted to cut a web leader during a reel spool change;

at least one separation element positioned for additionally cutting the material web;

a sensor positioned to monitor cutting by said at least one contactless cutter; and a control device coupled to said separation element and to said sensor, said control device being structured and arranged to activate said separation element when a defective cutting is detected by said sensor.

44. An apparatus for winding a material web comprising:

a reel spool;

a carrying roll;

said reel spool and said carrying roll positioned to form a winding nip, wherein the material web is guided over said carrying roll and through the winding nip;

at least one contactless cutter, which is positioned downstream from said winding nip, relative to a web travel direction, being adapted to cut a web leader during a reel spool change; and at least one separation element positioned for additionally cutting across an entire width of the material web.

45. The apparatus in accordance with claim 44, wherein said at least one separation element is positioned downstream of said contactless cutter.

46. The apparatus in accordance with claim 44, wherein said contactless cutter is positioned to cut the material web where it is in contact with said new reel spool.

47. The apparatus in accordance with claim 44, wherein said contactless cutter is positioned to cut the material web where it is unsupported.

48. The apparatus in accordance with claim 44, further comprising:

a sensor positioned to monitor cutting by said at least one contactless cutter; and a control device coupled to said separation element and to said sensor, said control device being structured and arranged to activate said separation element when a defective cutting is detected by said sensor.

* * * * *